US005461749A

United States Patent [19]

Ahlberg et al.

[11] Patent Number: 5,461,749

[45] Date of Patent: Oct. 31, 1995

[54] FLOOR MOP AND CLEANING SYSTEM

[75] Inventors: Carl S. Ahlberg, Minneapolis; James A. Wilson, North St. Paul; James R. Harrison, Oakdale, all of Minn.

[73] Assignee: Minnesota Mining and Manufacturing Company, St. Paul, Minn.

[21] Appl. No.: 251,618

[22] Filed: May 31, 1994

[51] Int. Cl.[6] ..... A47L 13/256

[52] U.S. Cl. ..... 15/228; 15/150; 15/231

[58] Field of Search ..... 15/147.1, 147.2, 15/150, 228, 231, 232

[56] References Cited

U.S. PATENT DOCUMENTS

| | | | |
|---|---|---|---|
| 839,006 | 12/1906 | Larson | 15/150 |
| 1,114,163 | 10/1914 | Mansfield | 15/228 |
| 2,429,626 | 10/1947 | Horn | 15/231 |
| 3,012,264 | 12/1961 | Nash | 15/231 |
| 3,358,313 | 12/1967 | Grimes | 15/231 |
| 3,395,415 | 8/1968 | Leland | 15/228 |
| 3,411,173 | 11/1968 | Berrington et al. | 15/231 |
| 3,465,377 | 9/1969 | Thomas | 15/147.2 |
| 3,641,612 | 2/1972 | Clurman et al. | 15/231 |
| 3,760,450 | 9/1973 | Griffin et al. . | |
| 3,778,860 | 12/1973 | Thielen . | |
| 3,787,919 | 1/1974 | Siemund . | |
| 3,850,533 | 11/1974 | Thielen | 403/58 |
| 3,911,521 | 10/1975 | Franchot . | |
| 3,983,596 | 10/1976 | Siemund | 15/244.1 |
| 3,991,431 | 11/1976 | Thielen | 15/147.2 |
| 4,114,223 | 9/1978 | Buchanan | 15/228 |
| 4,225,998 | 10/1980 | Thielen | 15/231 |
| 4,422,203 | 12/1983 | Zenker | 15/150 |
| 4,648,738 | 3/1987 | Thielen | 403/341 |
| 4,991,250 | 2/1991 | Young | 15/228 |
| 5,012,544 | 5/1991 | Verry | 15/231 |
| 5,218,734 | 6/1993 | Sacks | 15/147.2 |
| 5,243,729 | 9/1993 | Tomm | 15/147.1 |

FOREIGN PATENT DOCUMENTS

| | | | |
|---|---|---|---|
| 667930 | 8/1965 | Belgium | 15/231 |
| 265684 | 5/1988 | European Pat. Off. | 15/231 |
| 0287533 | 10/1988 | European Pat. Off. . | |
| 796438 | 1/1936 | France | 15/228 |
| 2720622 | 11/1978 | Germany . | |
| 200894 | 7/1923 | United Kingdom | 15/150 |
| 235084 | 6/1925 | United Kingdom | 15/231 |
| 299283 | 10/1928 | United Kingdom | 15/231 |

*Primary Examiner*—Mark Spisich

*Attorney, Agent, or Firm*—Gary L. Griswold; Walter N. Kirn; Leland D. Schultz

[57] ABSTRACT

A floor mop for cleaning a floor. The floor mop includes a mop head and a handle pivotally connected to the mop head. A disposable cleaning sheet is attached by a minor portion adjacent one edge to a leading edge of the mop head, leaving a major portion of the cleaning sheet free. The mop may be passed over the floor with one side of the cleaning sheet presented for cleaning the floor. The mop head may then be inverted with the other side of the cleaning sheet presented for further cleaning of the floor.

20 Claims, 10 Drawing Sheets

FLOOR MOP AND CLEANING SYSTEM

FIELD OF THE INVENTION

This invention relates generally to cleaning devices and more particularly to floor mops.

BACKGROUND OF THE INVENTION

Floor mops, also referred to as "dust mops" have been developed in several forms in the past for cleaning floors or like surfaces. For instance, so called "string mops" have been in common usage, such as the cotton or cotton/synthetic yarn products available from Tu-way American Group of Rockford, Ohio; Paragon Mop Co. of Charlotte, N.C.; the Zephyr Manufacturing Co. of Sedalia, Mo.; and Wilen Co., of Atlanta, Ga. Such floor mops are effective, but are relatively expensive and are therefore generally repeatedly reused and cleaned, and must eventually be repaired or replaced.

More recently, due to concerns over hygiene and safety in dealing with hazardous chemical or biological wastes that may be spilled or otherwise present on floors in locations such as hospitals and nursing homes, it has become highly desirable to provide a floor mop wherein the portion that contacts the floor is replaceable.

One such system that has been developed in the past is the 3M™ brand Doodleduster™ dusting system (the "Doodleduster System"), available from Minnesota Mining and Manufacturing Company ("3M") of St. Paul, Minn. The Doodleduster system (shown in FIGS. 1, 2A and 2B) includes a floor mop 10 having a mop head 12 and a handle 14 for manipulating the floor mop. The handle 14 is pivotally connected to the mop head by connection member 16, such as is described in U.S. Pat. No. 3,850,533 entitled "Positional Universal Joint".

The structure of the mop head is described in U.S. Pat. No. 4,225,998 entitled "Dust Mop Frame". The mop head includes a central portion 20 having a top surface 22, an opposing bottom surface 24, a longitudinal leading surface 26, a longitudinal trailing surface 28, and opposing end surfaces 30 and 32, respectively. Toggle assemblies 34 are mounted on top surface 22 of the central portion in spaced aligned pairs.

A rectangular segment 36 of dusting fabric is applied to the bottom surface 24 and the opposing longitudinal edges 38 and 40. The dusting fabric is engaged with the toggle assemblies 34 along opposing longitudinal edges to secure the dusting fabric to the mop head. One major surface 37 of the dusting fabric 36 is presented for encountering a surface (not shown) for cleaning the surface. The opposite major surface 39 faces bottom surface 24 of the mop head and, as shown in FIG. 2A, longitudinal edge 38 extends beyond leading surface 26 and opposing longitudinal edge 40 extends beyond trailing surface 28.

Toggle assembly 34 includes toggle member 44 hingedly connected (as at 46) by aligned hinge members projecting from the top surface 22 of the mop head. Toggle members 44 include a handle portion 50 for manipulating the toggle member to a first, open position (as at the right side of FIG. 2A) permitting the edge 38 of the cleaning fabric 36 to be placed over top surface 22; the toggle member 44 may then be shifted (by rotation in direction 52) to a second, closed position (as at the left side if FIG. 2A, and in FIG. 2B) to engage and retain the cleaning fabric on the mop head, by way of projecting tang 54. Tang 54 is aligned with groove 56 formed in top surface 22. Tang 54 and groove 56 cooperatively frictionally engages the cleaning fabric. A spring member 60 is mounted on the top surface 22 of the mop head to resiliently frictionally engage the toggle member and retain it in either the open or closed positions. The floor mop is used to clean a floor and when the cleaning capacity of exposed cleaning surface 37 is reached, the toggle assemblies are disengaged, the dusting fabric removed, reversed, reinstalled and the toggle assembles reengaged, enabling the floor mop to be used for further cleaning.

The Doodleduster™ system, while having its own utility, does exhibit certain limitations. As previously discussed, the handling of a used dusting fabric is particularly undesirable in environments where the handler may be exposed to chemical or biological hazards when handling the dusting cloth. 0f course, safety measures such as gloves or other like protective devices may be employed, but at the expense of increased cost and decreased convenience to the user.

Another problem is that an undesirably large portion of the dusting cloth may not be utilized at all to clean the floor, but is required merely to extend to reach the toggle assemblies 34 on the top surface 22 of the central portion 20 of the mop head to secure the dusting cloth to the mop head. This inefficiently utilizes the material of the dusting cloth and undesirably increases the cost of using the Doodleduster™ cleaning system.

Therefore, it would be desirable to provide a floor mop that more efficiently uses disposable cleaning material and minimizes contact with the contaminated cleaning material by the user.

SUMMARY OF THE INVENTION

The present invention provides a floor mop for cleaning a floor. The floor mop includes a mop head having a longitudinal leading edge, a longitudinal trailing edge, a first end and an opposing second end, a first cleaning support surface and an opposing second cleaning surface. A flexible cleaning sheet is provided having a first cleaning surface and an opposing second cleaning surface and a longitudinal attachment edge. Securing means are provided for releasably attaching a portion of the cleaning sheet to the mop head adjacent to and parallel to the attachment edge of the cleaning sheet, leaving a major portion of the cleaning sheet free. The floor mop includes a handle member adapted for manual engagement and means are provided for pivotally connecting the handle member to the mop head enabling the mop head to be shifted by manipulating the handle member between a first position with the first cleaning surface of the mop head presented to the floor with the cleaning sheet interposed between the first cleaning support surface and the floor and the free portion of the cleaning sheet extending from the attachment means towards the trailing edge of the mop head so as to present the first cleaning surface of the cleaning sheet to encounter the floor as the mop head is moved in relation thereto, and a second position with the second cleaning surface of the mop head presented to the floor with the cleaning sheet interposed between the second cleaning support surface and the floor and the free portion of the cleaning sheet extending from the attachment means towards the trailing edge of the mop head so as to present the second cleaning surface of the cleaning sheet to encounter the floor as the mop head is moved in relation thereto.

In one embodiment of the invention, the cleaning sheet is a non-woven fabric constructed of polymeric fibers. In another embodiment of the invention, the invention is a floor cleaning system that includes the floor mop as herein described, in combination with a length of a flexible cleaning sheet having a first cleaning surface and an opposing second cleaning surface and a longitudinal attachment edge, the length of the cleaning sheet including a plurality of transverse weakened lines for manually separating a discrete segment of the cleaning sheet, wherein sequential segments of the cleaning sheet may be detached from the length of cleaning sheet material, attached to the mop head and applied on both cleaning surfaces to the floor and then removed from the mop head and replaced by the next cleaning sheet segment seriatim.

BRIEF DESCRIPTION OF THE DRAWINGS

The present invention will be further described with reference to the accompanying drawing wherein like reference numerals refer to like parts in the several views, and wherein.

DETAILED DESCRIPTION OF THE INVENTION

Figure 1:
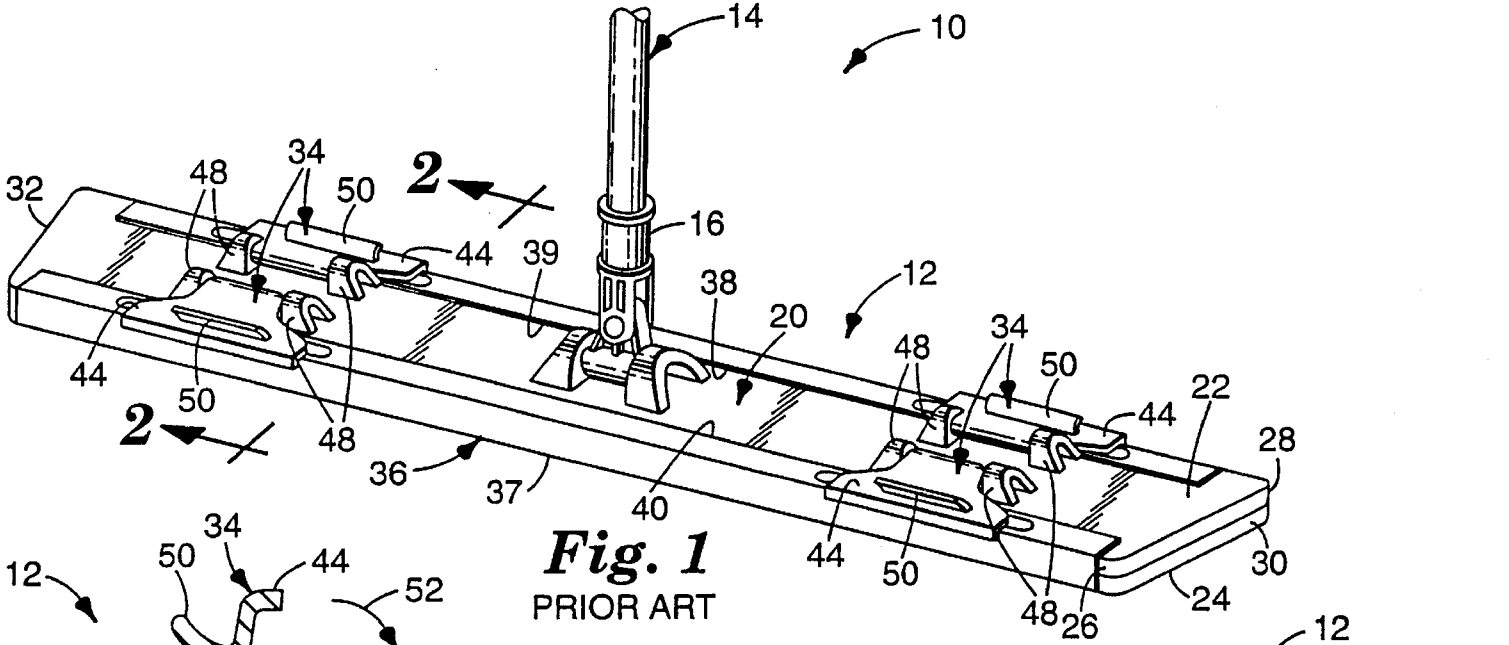
Fig. 1 PRIOR ART
FIG. 1 is a perspective view of a floor mop according to the prior art.
Figure 2B:
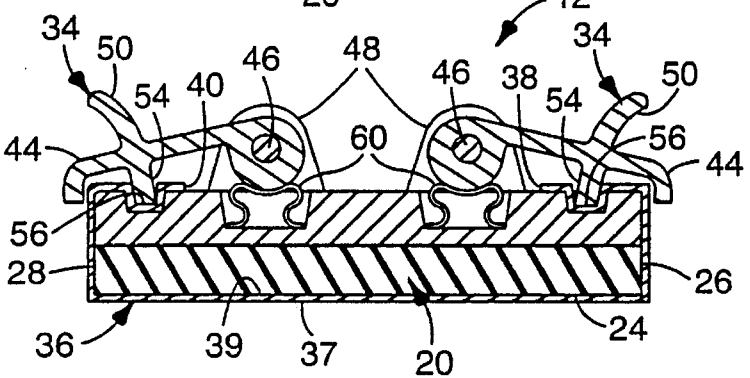
Fig. 2B PRIOR ART
FIG. 2B is a side view of the prior art floor mop in FIG. 2A with the toggle assemblies in a closed position.
Figure 2A:
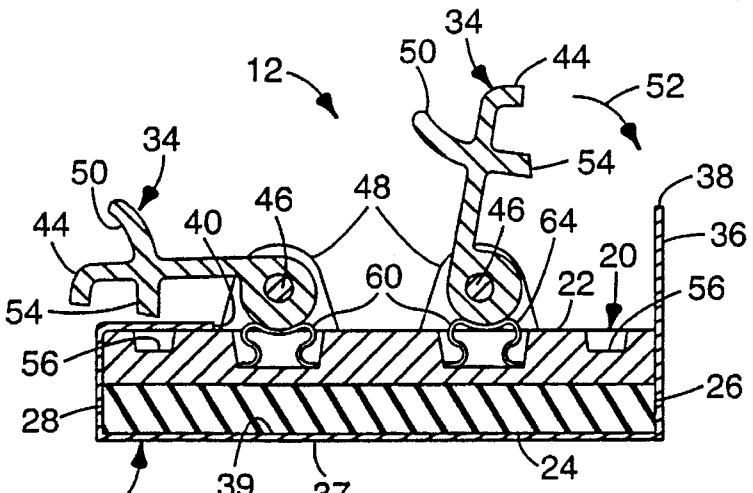
Fig. 2A PRIOR ART
FIG. 2A is a side view of the prior art floor mop of FIG. 1 with one toggle assembly in an open position.
Figure 3:
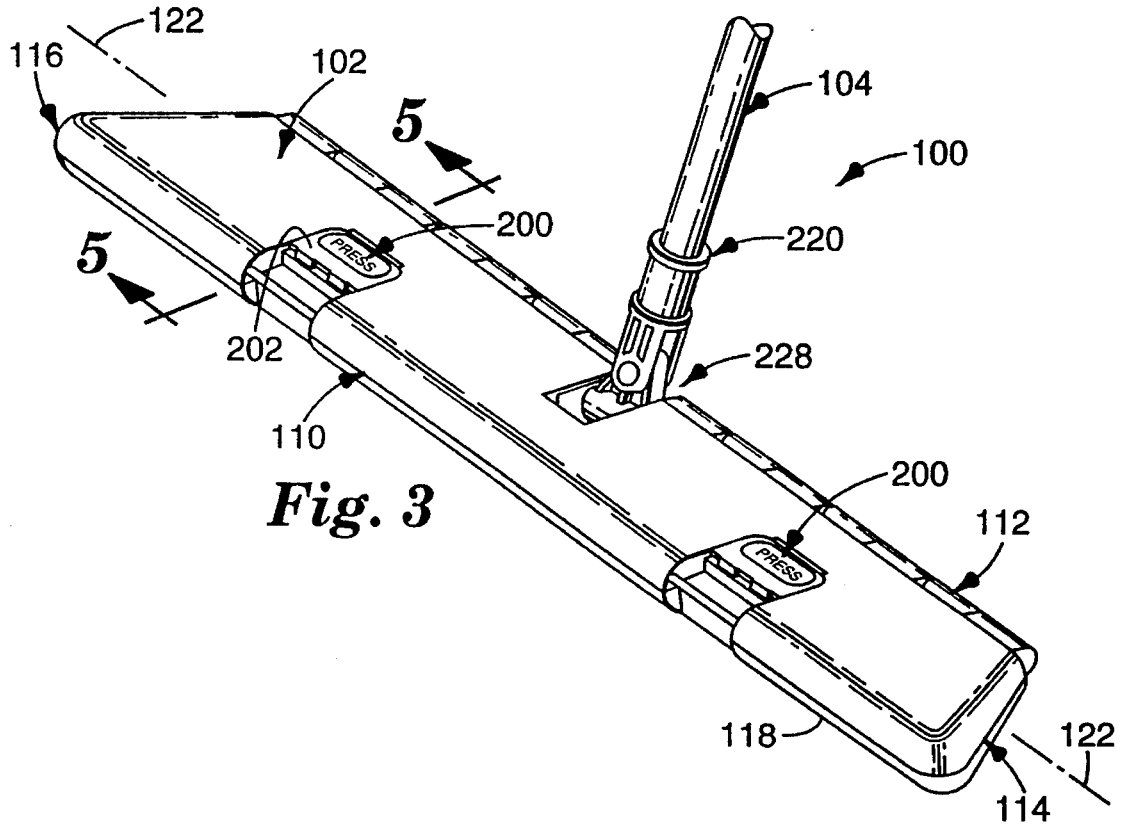
FIG. 3 is a perspective view of one embodiment of the floor mop of the present invention.

Turning now to FIG. 3, there is shown a floor mop 100 according to the present invention. The floor mop 100 includes a mop head 102 and a handle member 104. Mop head 102 includes a longitudinal leading edge 110, a longitudinal trailing edge 112, opposing ends 114 and 116, first cleaning support surface 118 and second cleaning support surface 120 (shown in FIG. 4C). In the preferred embodiment of the invention, the leading edge 110 and trailing edge 112 are parallel to longitudinal axis 122. First cleaning support surface 118 and second cleaning support surface 120 are also preferably parallel to each other. Also, in the preferred embodiment of the invention, the ends 114,116 are tapered from the leading edge 110 to the trailing edge, as shown in FIG. 3. This arrangement facilitates access to corners or like locations during use of the floor mop.

Figure 6A:
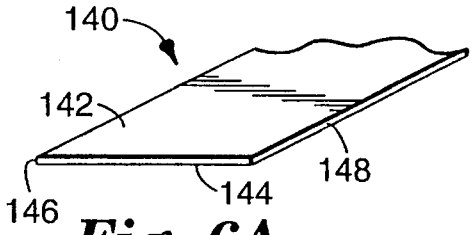
FIG. 6A is a perspective view of a portion of a segment of a cleaning sheet.

A cleaning sheet or dusting sheet 140 (shown in FIGS. 6 and 6A) is provided to clean a surface, such as a floor (not shown) through sliding contact therewith. The cleaning sheet 140 may be formed from any suitable flexible material adapted to collect the substance that is to be cleaned from a surface. The cleaning material may be woven, non-woven, or have a sponge-like structure, or any other suitable arrangement. For instance, a non-woven fabric may be employed that is constructed from processes such as by spunbonding or by fibrillation.

In most applications, it is anticipated that the cleaning sheet will be adapted to collect particulate matter, such as dust, from a floor or other like surface to be cleaned and retain most particulate matter on or in the sheet member. In this embodiment, the floor mop is more particularly referred to as a dust mop. It is also possible to select a material to construct the cleaning sheet of a material that absorbs liquid materials. For instance, it is possible to select a material that is hydrophobic or hydrophilic. Similarly, it is possible to select a material to construct the cleaning sheet that is selectively oleophobic or oleophilic. The following is a non-exclusive list of materials that may be used to construct the cleaning sheet: cellulosic fibrous web, polypropylene, polyethylene, and rayon webs.

In the preferred embodiment of the invention, the cleaning sheet is constructed of an embossed web, between 1–30 mm in thickness, constructed of non-woven, random discontinuous blown microfibers and crimped macrofibers of polymeric materials according to U.S. Pat. No. 4,118,531, entitled "Web of Blended Microfibers and Crimped Bulking Fibers," the contents of which are incorporated herein by reference. Most preferably, the fibers comprise a 60/40 blend of polypropylene/polyester. In the preferred embodiment of the invention, the cleaning sheet has a basis weight of 41.0 grams/meter sq. Such material is available from the Minnesota Mining and Manufacturing Company ("3M") of St. Paul, Minn. under the trademark Doodleduster™ cloth.

Figure 6:
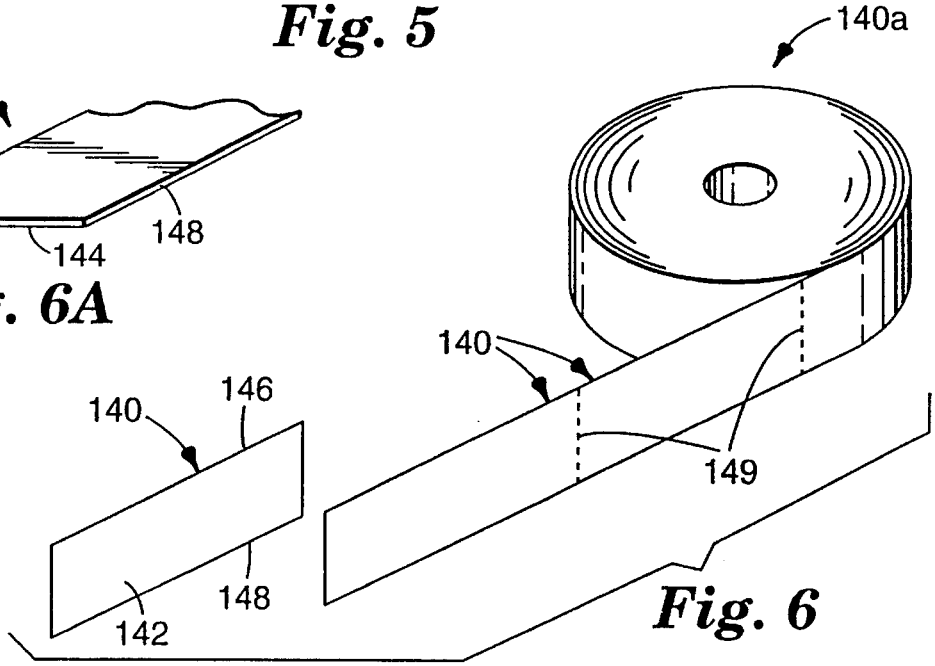
FIG. 6 is a perspective view of a roll of the cleaning sheet material, with a segment detached.

The cleaning sheet 140 includes a first cleaning surface 142 and an opposing second cleaning surface 144. Preferably, the cleaning sheet is rectangular in shape and includes a longitudinally extending attachment edge 146 and a parallel trailing edge 148. A plurality of the cleaning sheets may be conveniently provided individually, stacked, or fan folded, most conveniently, the cleaning sheet is providing as part of a continuous strip in roll form 140*a*, as is also shown in FIG. 6. The cleaning sheet material may be severed from the free end of the roll in desired lengths, such as with a knife or scissors. However, the roll 140*a* may be constructed with a plurality of transverse weakened lines 149 at selected spaced locations. Although the weakened line may be formed such as by scoring the cleaning sheet material, in the preferred embodiment of the invention, the weakened line takes the form of a perforated line. The weakened lines 149 enable a segment of the cleaning sheet material to be manually separated from the roll. The weakened lines 149 may be located at desired regular intervals so that a single segment, or multiple segments may be separated as a unit (not shown) seriatim so that a single roll may be provided to supply cleaning sheet material to a variety of floor mops of different sizes. Although it may be possible to clean the cleaning sheet and reuse it, in the preferred embodiment of the invention, the cleaning sheet is discarded after use and replaced with a fresh, unused cleaning sheet in manner described in greater detail hereinafter.

Means are provided to secure the flexible cleaning sheet to the leading edge of the mop head. For instance, a stiffening strip (not shown) may be attached to the attachment edge 146 of the cleaning sheet and the attachment edge inserted into and frictionally engaged with a slot (not shown) in the leading edge 110 of the mop head.

Alternatively, the mop head may be constructed with plurality of projections, such as the "hook" portion of a hook and loop mechanical fastener system. The hooks or projections are used to engage and retain the cleaning sheet on the mop head. Such hooks are described in U.S. Pat. No. 4,454,183, entitled "Strip Material With Heat Formed Hooked Heads". In the preferred embodiment of the invention, the mop head is constructed of pair of cooperative segments.

In the embodiment of the invention illustrated in FIGS. 3–7, the mop head segments take the form of first head portion 150*a* and second head portion 150*b*. Each mop head portion 150*a*, 150*b* includes outer surfaces 152*a*,152*b*, facing inner surfaces 154*a*,154*b*, a leading edge 156*a*,156*b*, a trailing edge 158*a*,158*b*, and respective opposing ends, 160*a*,160*b* and 162*a*,162*b*.

Figure 4A:
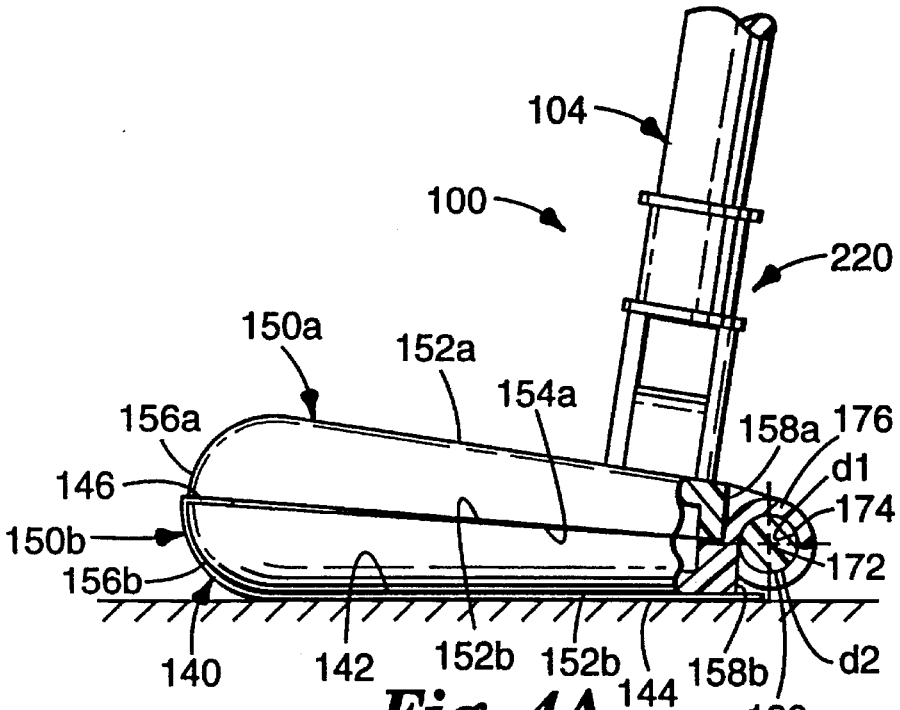
FIG. 4A is an end view of the floor mop of FIG. 3 in a closed position, partially broken away, with a cleaning sheet secured thereto.
Figure 4B:
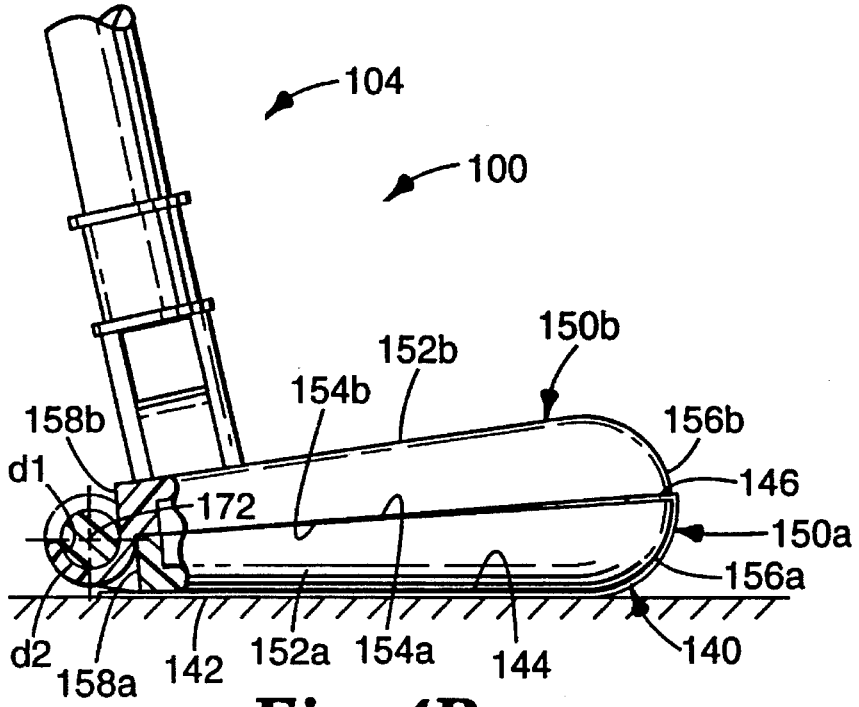
FIG. 4B is an opposite end view of the floor mop of FIG. 4A, partially broken away, with the cleaning fabric reversed.
Figure 4C:
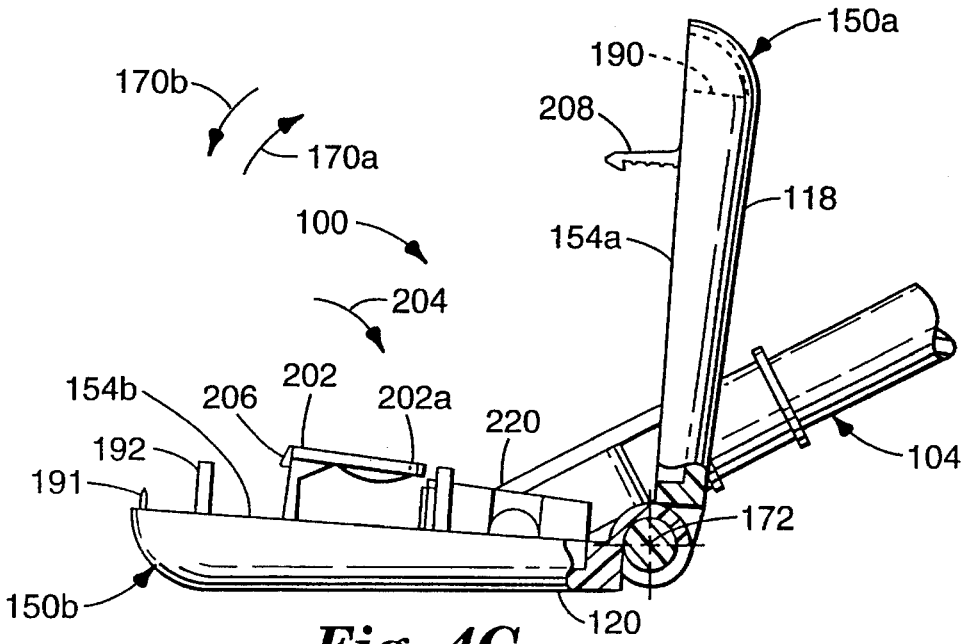
FIG. 4C is a side view of the floor mop of FIG. 4 in an open position and the cleaning sheet removed.

The first mop head portion 150*a* and the second mop head portion 150*b* are shiftable with respect to each other between a first closed position, as shown in FIGS. 4A and 4B, wherein the respective leading edges 156*a*,156*b* are adjacent each other; and a second, open position, as shown in FIG. 4C, wherein the leading edges 156*a*,156*b* are spaced apart. When in the open position, a cleaning sheet 140 may be inserted in between the facing surfaces 154*a*, 154*b* so that when the mop head portions 150*a*,150*b* are shifted to their closed position, the cleaning sheet is engaged with the mop head.

Any suitable mechanism may be employed to shift the mop head portions 150*a*,150*b* between the open and closed positions. In the preferred embodiment of the invention, the first mop head portion and the second mop head portion are hingedly connected adjacent the respective trailing edges 158*a*,158*b* thereof so as to rotate in opposite rotational directions 170*a*,170*b* about longitudinal axis 172.

Figure 7:
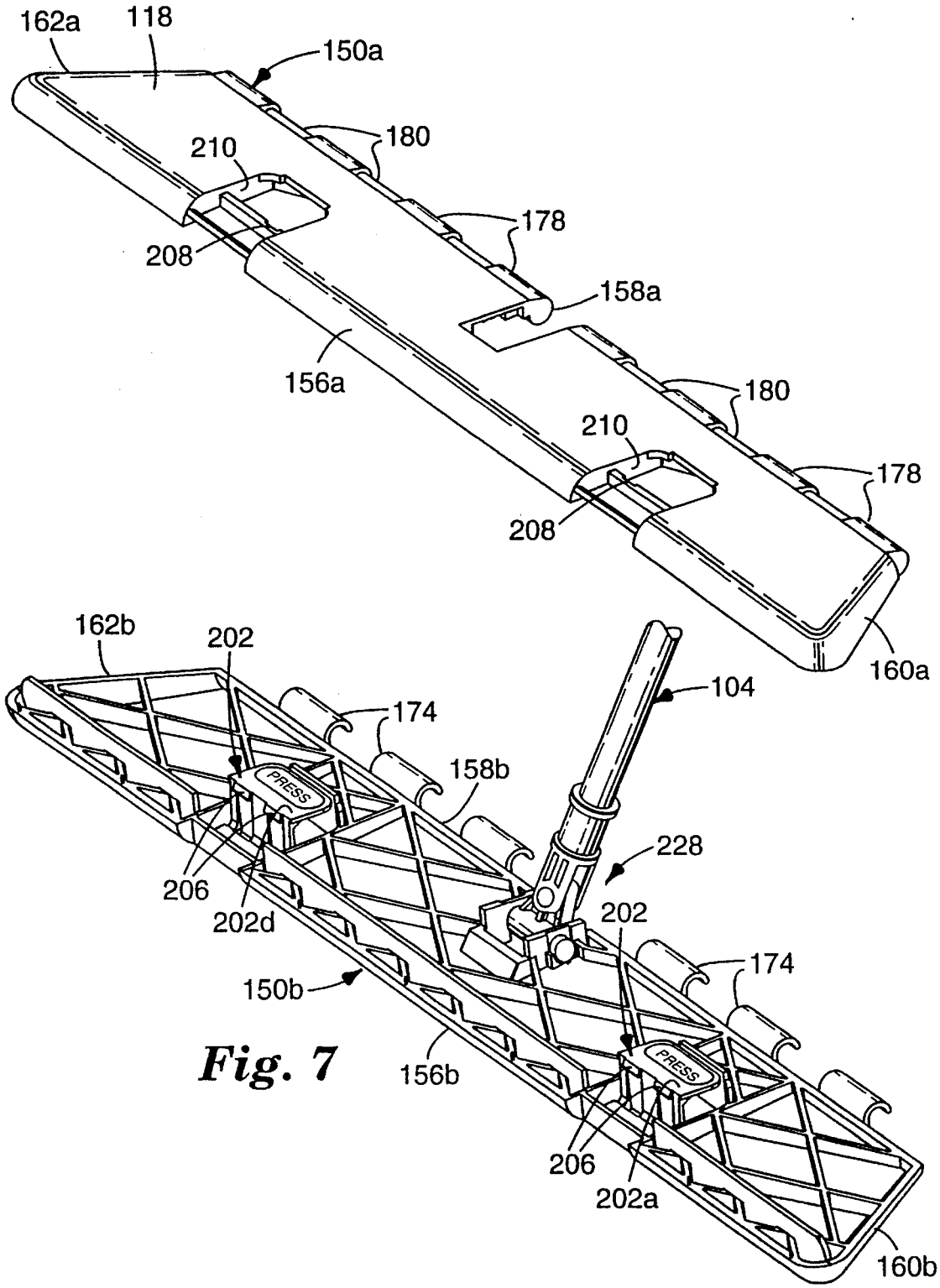
FIG. 7 is an exploded perspective view of the first mop head portion and second mop head portion.
Figure 8:
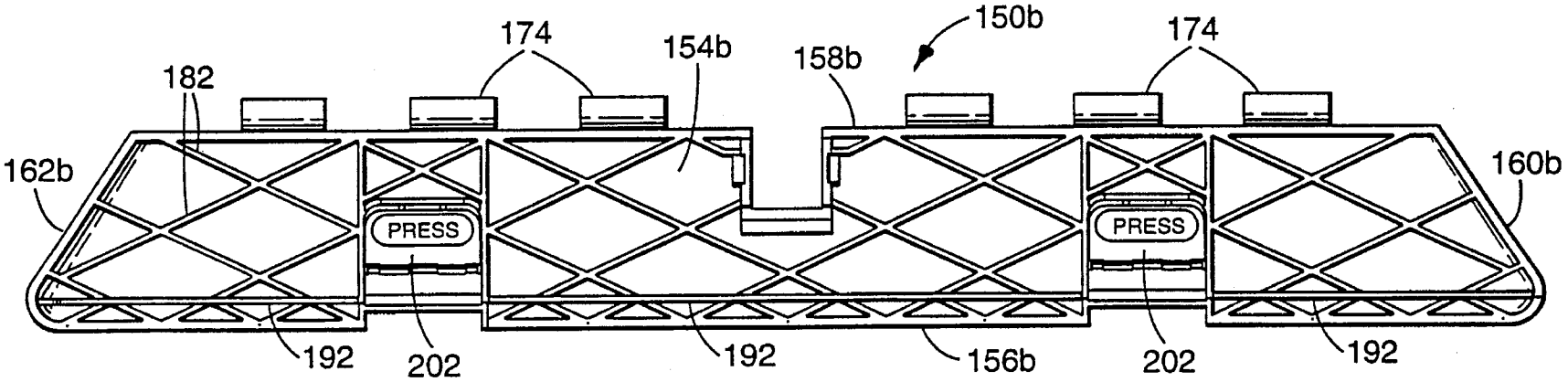
FIG. 8 is top view of the second mop head portion of FIG. 7.
Figure 9:
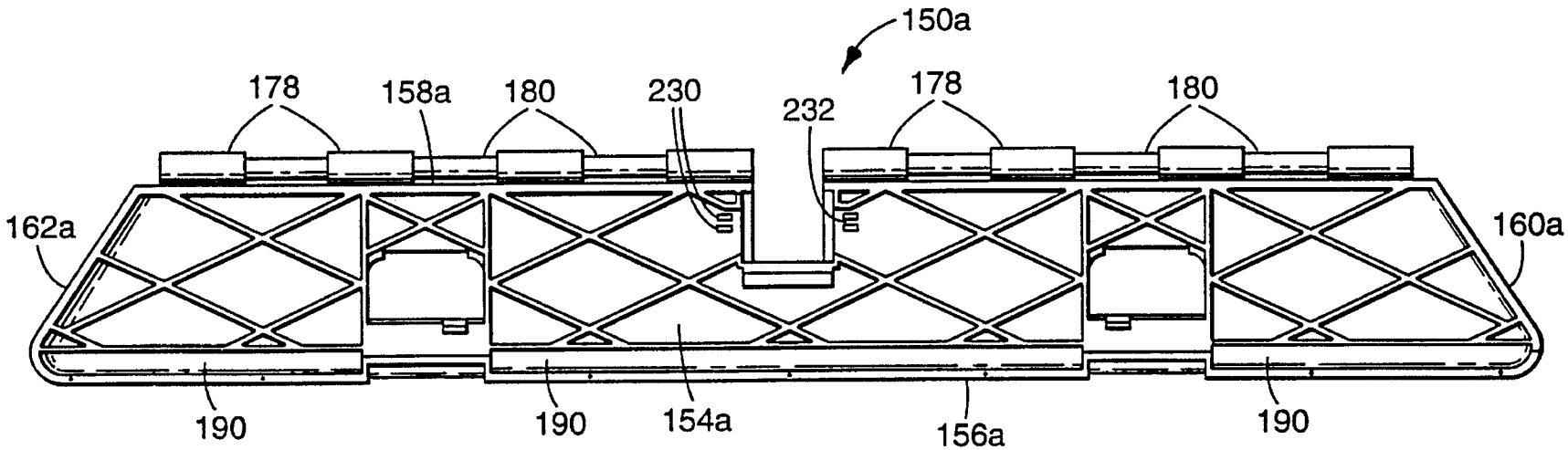
FIG. 9 is a bottom view of the first mop head portion.

As is shown more particularly in FIGS. 7, 8 and 9, the hinged connection may be constructed by providing a plurality of spaced arcuate sections 174 projecting from the trailing edge 158*b* of the second mop head portion 150*b*. The projections 174 each define an aligned cylindrical surface 176, (as shown in FIG. 4B) having an inner diameter $d_1$. A plurality of like sized, solid arcuate projections 178 extend from the trailing edge 158*a* of the second mop head portion 150*a*. Extending longitudinally between the projections 178 along the trailing edge 158*a* of the first mop head portion 150*a* are hinge rods 180. The hinge rods 180 have an outer diameter $d_2$. Diameter $d_2$ and diameter $d_1$ defined by projections 174 are sized so as to form a sliding rotative fit when the hinge rods 180 are engaged with the cylindrical surfaces 176 by interdigitating the hinge rods with the projections 174 of the first mop head portion. This arrangement enables the first and second mop head portions to rotate relative to each other in opposing rotative directions 170*a*,170*b* between the open and closed positions, as previously described. Of course, any other suitable hinge structure may be employed. Of course, the relative locations of the arcuate projections 174 and the hinge rods 180 may be reversed with respect to the first and second mop head portions, if desired.

However, the illustrated embodiment facilitates the construction of the first mop head portion and the second mop head portion to be molded in unitary manner, preferably from a polymeric material. The following is a non-exclusive list of the polymeric materials from which the first and second mop head portions may be molded: urethane, acrylonitrile butadiene styrene (ABS), polypropylene, and nylon. In any case, the components of the floor mop, including the mop head and the cleaning sheet, should be constructed from materials that are resistant to the environment and substances to which the floor mop is exposed during use.

As is shown more particularly in FIGS. 8 and 9, the molded first and second mop head portions may be preferably constructed with a reduced amount of material to reduce material expense, such as by including reinforcing ribs 182 on the facing surfaces 154*a* and 154*b*. Preferably, all corners or obstructions are avoided, such as at the intersection of the ribs, to facilitate cleaning of the mop head portions. However, it has been found that a minimum weight for the mop head should be maintained in order to ensure the effective cleaning of the floor to which the floor mop is applied. In the preferred embodiment of the present invention, the preferred weight of a mop head that is 26.5 inches×4.0 inches is at least 600 grams and is most preferably approximately 660 grams.

Further, the facing surfaces 154*a*,154*b* of the first and second mop head portions may be so constructed as to facilitate the securement of the cleaning sheet to the mop head when the first and second mop head portions are in their closed position. In the illustrated embodiment, this is accomplished by providing one or more prongs 191 projecting from at least one of the facing inner surfaces 154*a*,154*b* (preferably projecting from surface 154*b* as shown in FIG. 4C). The cleaning cloth 140 is engaged with the prongs and then secured by shifting the first and second mop head portions 150*a*,150*b* to their closed position.

A longitudinal channel 190 is formed in the inner surface 154*a* of the first mop head portion adjacent to the leading edge. A longitudinal ridge 192 projects from surface 154*b* of second mop head portion 150*b* and is aligned with channel 190 and extends into the channel when the first and second mop head portions are in their closed position. Ridge 192 contacts attachment edge 146 of the cleaning cloth 140 and forms a stop to locate the cleaning cloth with respect to the mop head. This arrangement controls the amount of the cleaning cloth that is used to secure the cleaning cloth to the mop head.

Figure 4D:
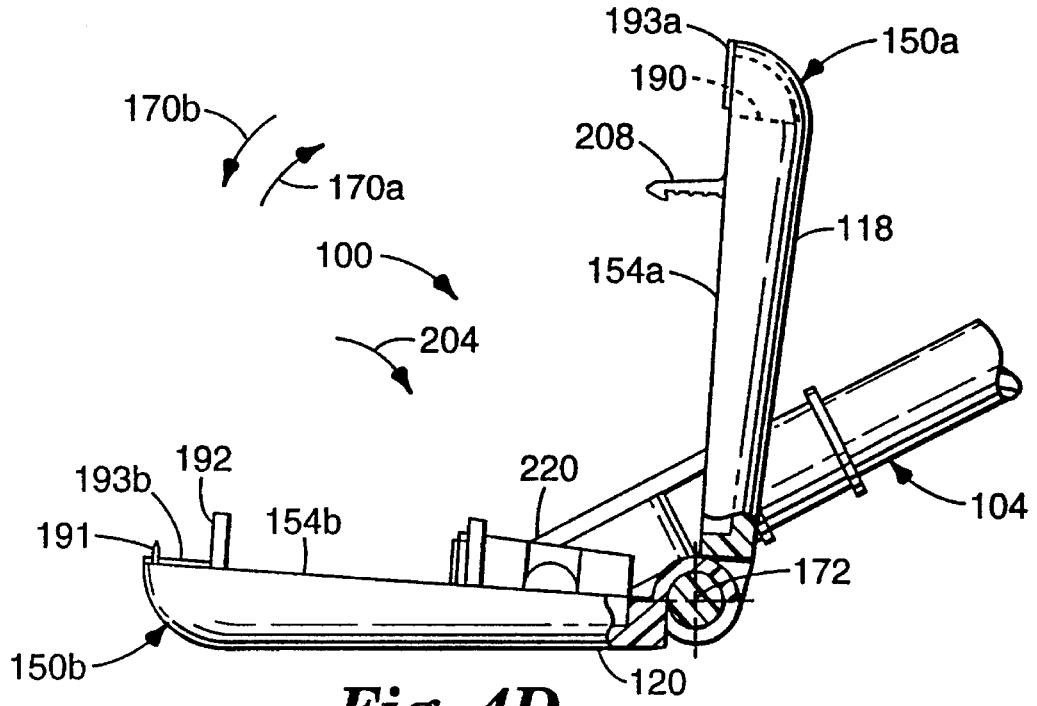
FIG. 4D is a side view of an alternate embodiment of the floor mop of the present invention in an open position including a magnetic latch.

Means are provided to clamp the first mop head portion 150*a* and the second mop head portion 150*b* together when they are in their closed position to secure the cleaning sheet 140 in engagement with the mop head. Any suitable clamping arrangement may be employed, such as magnetic latches. One such magnetic latch is shown in FIG. 4D and includes magnetic member 193*a* mounted to one of the first or second mophead portions 150*a*, 150*b*, and an aligned magnetic latch member mounted on the opposing mophead portion, such that when the mophead portions are shifted to the closed position, the magnetic latch secures the mophead in the closed position a spring (not shown) to resiliently bias the first mop head portion and the second mop head portion in their closed position, or a mechanical snap closure (not shown), or hook and loop type mechanical fasteners as have previously been discussed herein.

Figure 5:
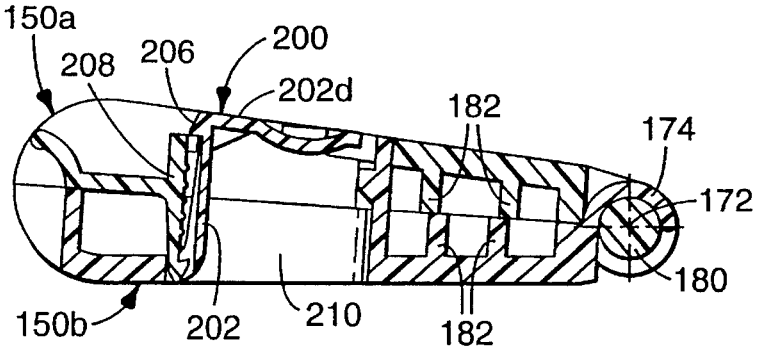
FIG. 5 is a cross sectional view along plane 5—5 of the floor mop of FIG. 3.

In the preferred embodiment of the invention, illustrated in FIGS. 3, 4C, 5, 7, 8 and 9, latch means are provided to clamp the first and second mop head portions together in the closed position. A pair of spaced latch assemblies 200 are included. Each latch assembly includes a generally "L" shaped latch member 202 projecting from the inner surface 154*b* of the second mop head portion 150*b*. The segment 202*a* of the latch member extends towards the trailing edge 158*b* of the second mop head portion. The latch member 202 is constructed to be resiliently biased to an upright position, as shown, yet permits the latch member to be deflected in rotational direction 204, as will be explained in greater detail hereinafter. One or more tangs 206 project from the latch member 202 facing the leading edge 156*b*. A second tang 208 projects from inner surface 154*a* of the first mop head portion 150*a*. The second tang 208 is located adjacent opening 210 extending through the first mop head portion 150*a*. When the first mop head portion 150*a* and the second mop head portion 150*b* are shifted to the closed position, as shown in FIG. 5, the first tang 206 and the second tang 208 are so constructed as to slidingly encounter each other, and to interlock so as to clamp the first mop head portion and the second mop head portion in the closed position. When it is desired to unclamp the first and second mop head portion, the segment 202*a* is pressed to deflect the latch member 202 in rotational direction 204. This rotational movement disengages the first and second tangs 206, 208, enabling the first and second mop head portions to be rotated to the open position. It is one of the features of the present inventions that the mop head may be opened to remove the cleaning sheet without contact with the cleaning sheet.

Handle member 104 is adapted for manual engagement. One end 220 of the handle member is connected to the mop head 102. Any suitable arrangement may be provided to connect the handle member to the mop head. Preferably, the handle member is pivotally connected to the mop head, to facilitate the manipulation of the mop head as hereinafter described. Most preferably, the handle member is pivotally connected to the mop head by a positional universal joint 228, such as is shown and described in U.S. Pat. No. 3,850,533, the contents of which are incorporated herein by reference. An operator may place the handle and frame in a pre-selected position to effectively clean a given surface, and when he desires, readily manually reposition the frame and handle without loosening or tightening screws, bolts, or other type of fastener.

The pivotal connection includes aligned holding members 230 projecting from inner facing surface of 154*b* second mop head portion 150*b*. Preferably, the holding members are integrally molded with the second mop head portion. The holding members 230 each have axially aligned openings 232 therethrough. The openings are parallel to the longitudinal axis 122 of the mop head.

Although the holding members could be located at any suitable location on the mop head, preferably, the openings 232 are centered at the midpoint of the mop head between the leading edges 156*a*,156*b* and the trailing edges 158*a*, 158*b*; and midway between the first cleaning support 142 surface and the second cleaning support surface 144; as well as midway between the first ends 160*a*,160*b* and the second ends 162*a*,162*b* of the mop head. It is believed that this location most effectively facilitates the manipulation of the mop head and most efficiently applies the force applied to the mop head form the handle member to urge the cleaning sheet into contact with the surface to be cleaned.

Connecting member 233 includes two aligned arms 234, 236, each having a first bore 238 extending therethrough. A second bore 240 extends though the connecting member about an axis that is at right angles to the axis of bore 238.

Handle holder 242 comprises arms 244, 246 having axially aligned circular openings 248, 250 therethrough. The upper end of handle holder 242 comprises socket 252 having internal threads 254 for attaching an externally complementarily threaded end 220 of the handle 104. If desired, threaded socket 252 can be replaced with any available type of handle member holding means. One of the bores is positioned between holding members 230, the other bore being positioned between openings 238,240 of arms 234, 236.

Holding members 230, connecting member 233, and handle holder 242 are securely attached to each other by means of plugs 260 which each include a head portion 262 and shank portion 264. Head 262 is slightly smaller in diameter than openings 238 and 240, and the diameter of shank 264 is about the same as the diameter of bores 238,240 to create a tight friction fit when shank 264 is inserted in bore. Shank 264 has annular ribs 266 to assist in securely retaining plugs 260 in bores 238,240 when shank 264 is inserted therein, and has groove 267 to permit escape of air when plug 260 is inserted in bore. Head portion 262 of plug 260 has annular groove 268 thereon to support a rubber friction ring such as O-ring 270. Rubber O-ring 270 has an inner circumference about the same as that seated therein, the thickness of O-ring 270 and the depth of groove 268 being such that part of O-ring 270 extends beyond head 262. O-ring 270 frictionally engages smooth inner walls 274 of bore 238 of connecting member 233 and smooth inner walls 276 of opening 238 in arms 234 and 236, the friction fit providing universal joint 228 with a freedom of movement which permits manual adjustment to various positions, the friction fit retaining the preselected position during use of the mop. If desired to permanently secure plugs 260 in place, their opposing ends may be adhered to each other or joined by other connecting means such as wires, suitable adhesives or the like.

The components of the pivotal connection are preferably made from materials which provide resistance to the environment in which the mop is to be used, as well as structural strength. Preferably, holding members 230, connecting member 233, and handle holder 242 are constructed of acrylonitrile-butadiene-styrene copolymer but may be of polyacetal, nylon, metal, etc. Plugs 260 are preferably constructed of glass fiber filled nylon or brass but may be of the same materials used for base holding members 230. O-rings 270 are preferably of a butadiene-acrylonitrile rubber copolymer having a durometer of about 70 to provide long life as well as good oil and water resistance.

The structure of the floor mop 100 of the present invention having been described, in operation, a cleaning sheet 140 is provided with the mop head 102 in its open position. The attachment edge of the cleaning sheet is inserted between the first and second mop head portions 150*a*,150*b*, and the mop head portions are shifted to their closed position and clamped therein to secure the cleaning sheet to the mop head. It is one of the features of the present invention, as compared to the conventional Doodleduster system, that only one edge of the cleaning sheet is required to be secured to the mop head. This enables a narrower cleaning sheet to be utilized, as compared to a comparable floor mop using the Doodleduster™ system. For mop heads of equal size, a cleaning sheet may be employed with the present invention that is approximately 30–33% smaller than the corresponding cleaning sheet required under the Doodleduster™ system.

Figures 10A, 10B:
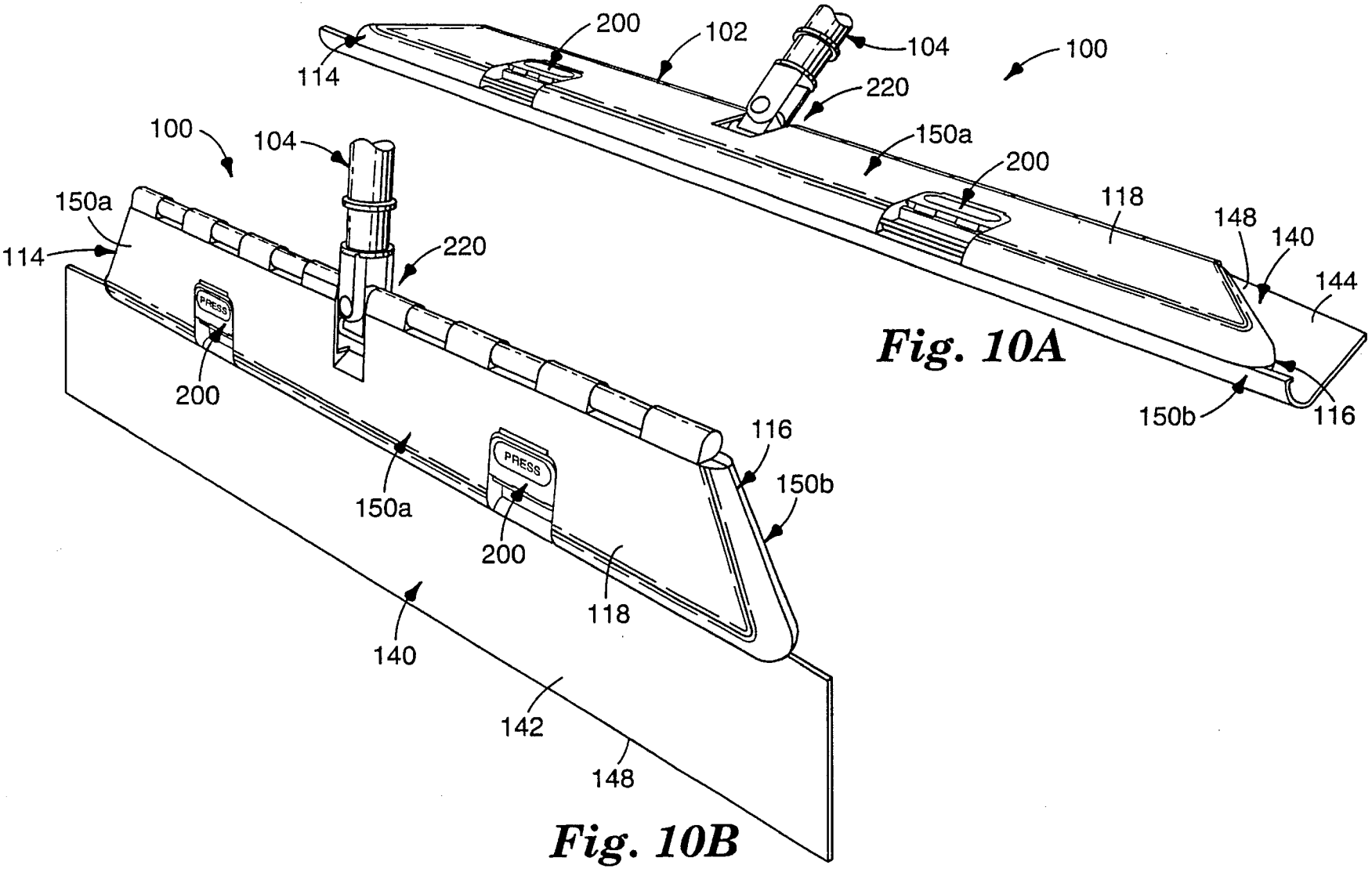
FIGS. 10A, 10B and 10C, are sequential perspective views of the mop head of FIG. 4 being inverted and the opposite cleaning surface of the cleaning sheet being presented for cleaning a floor.
Figure 10C:
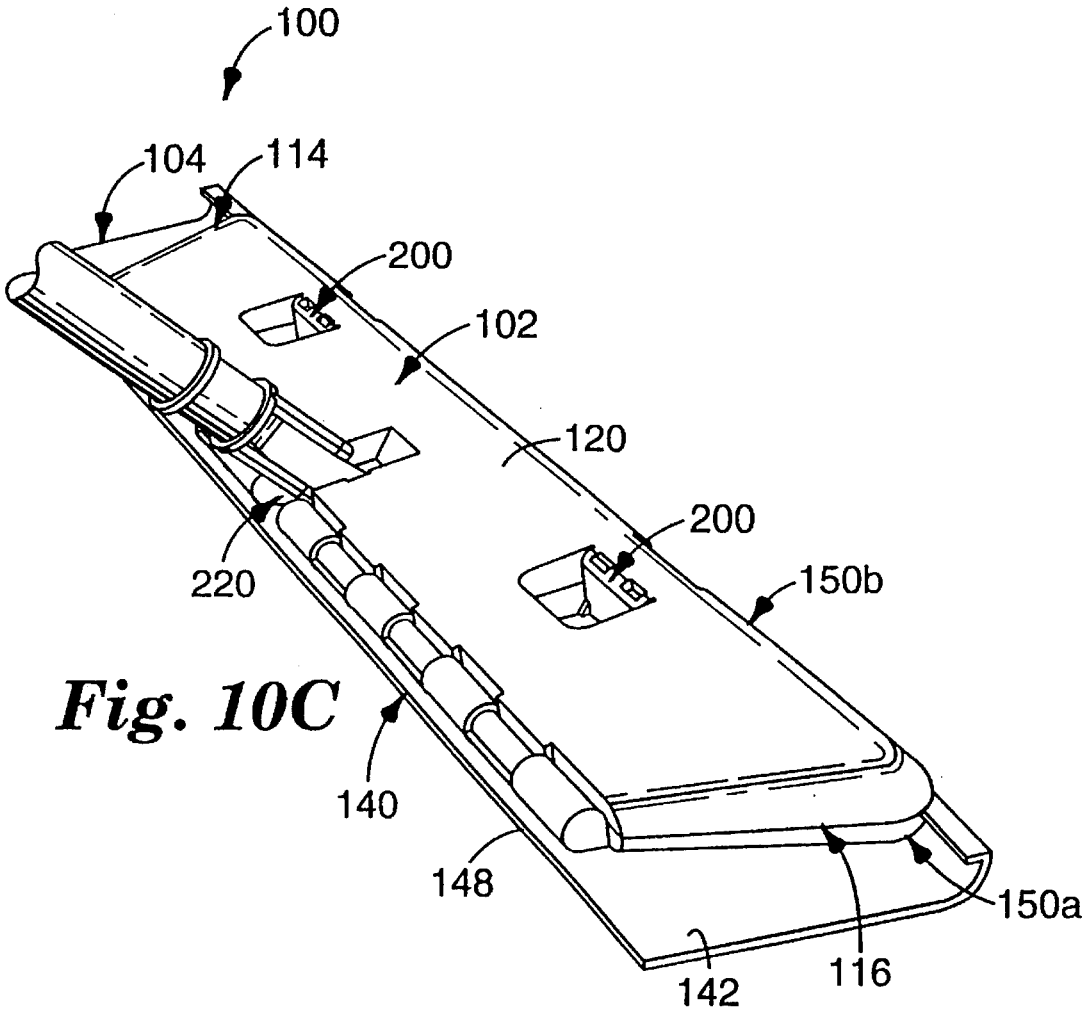
Figure 11A:
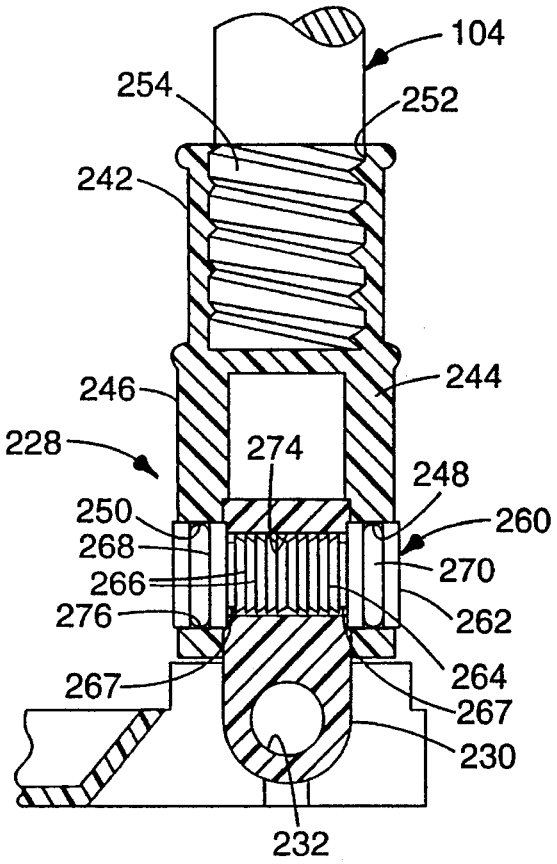
FIG. 11A is a side view, partially in cross section of the pivoting connection member connecting the handle to the mop head.
Figure 11B:
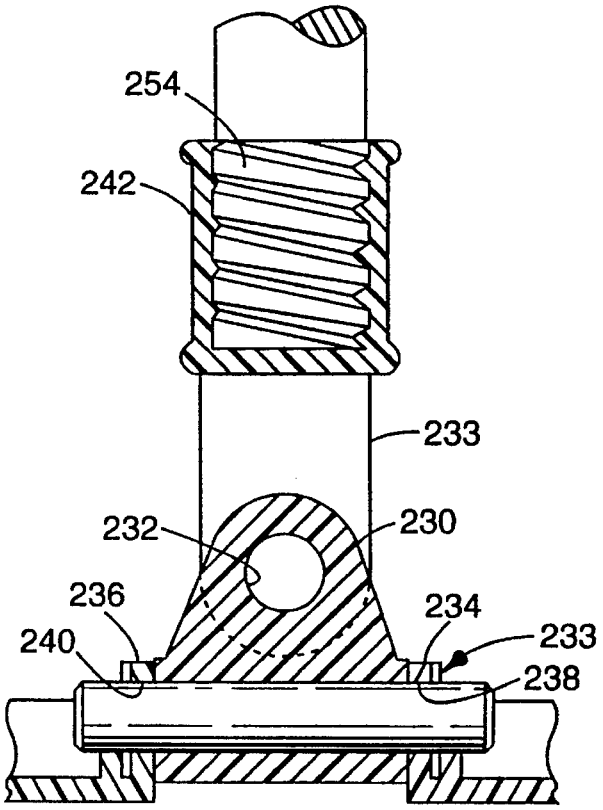
FIG. 11B is a front view, partially in cross section of the pivoting connection member connecting the handle to the mop head.

The mop head 102 is then manipulated by the handle member 104 so as to present the cleaning support surface 118 to the floor. The cleaning sheet 140 extends from the leading edge 110 of the mop head, wherein it is attached to the mop head, towards the trailing edge 112. Preferably, the cleaning sheet is constructed so that the free portion (that is the portion not secured to the mop head) covers the cleaning support surface 118 entirely and extends to the trailing edge 112. With the cleaning sheet interposed between the cleaning support surface 118 and the floor or surface to be cleaned (as shown in FIGS. 4A and 4B) and the first cleaning surface 142 of the cleaning sheet presented to the floor, the mop may be manipulated in any desired manner to clean the floor by collecting any encountered particulates, liquids or both. When the capacity of the first cleaning surface 142 of the cleaning sheet is reached, the mop may be quickly and easily manipulated to invert the mop head (as sequentially shown in FIGS. 10A, 10B and 10C) so that the second cleaning support surface 144 is directed towards the floor. This process is also less time consuming then the process for reversing the dusting fabric attendant in the Doodleduster™ system, which requires opening and closing of the toggle assemblies, as previously described herein. Simultaneously with the inversion of the mop head, the cleaning sheet is reversed so that the cleaning sheet extends from the leading edges 156*a*,156*b* towards the trailing edges 158*a*,158*b* over the second cleaning support surface 120 with the second cleaning surface 144 of the cleaning sheet presented to the floor. It will be understood that this process eliminates the need for the user of the floor mop to have any contact with the cleaning sheet. The cleaning of the floor may be resumed until the cleaning capacity of the second cleaning surface 144 of the cleaning sheet 140 is reached. At this point, the mop head is opened and the cleaning sheet removed with minimal, or preferably no, contact by the user and discarded.

Figure 3A:
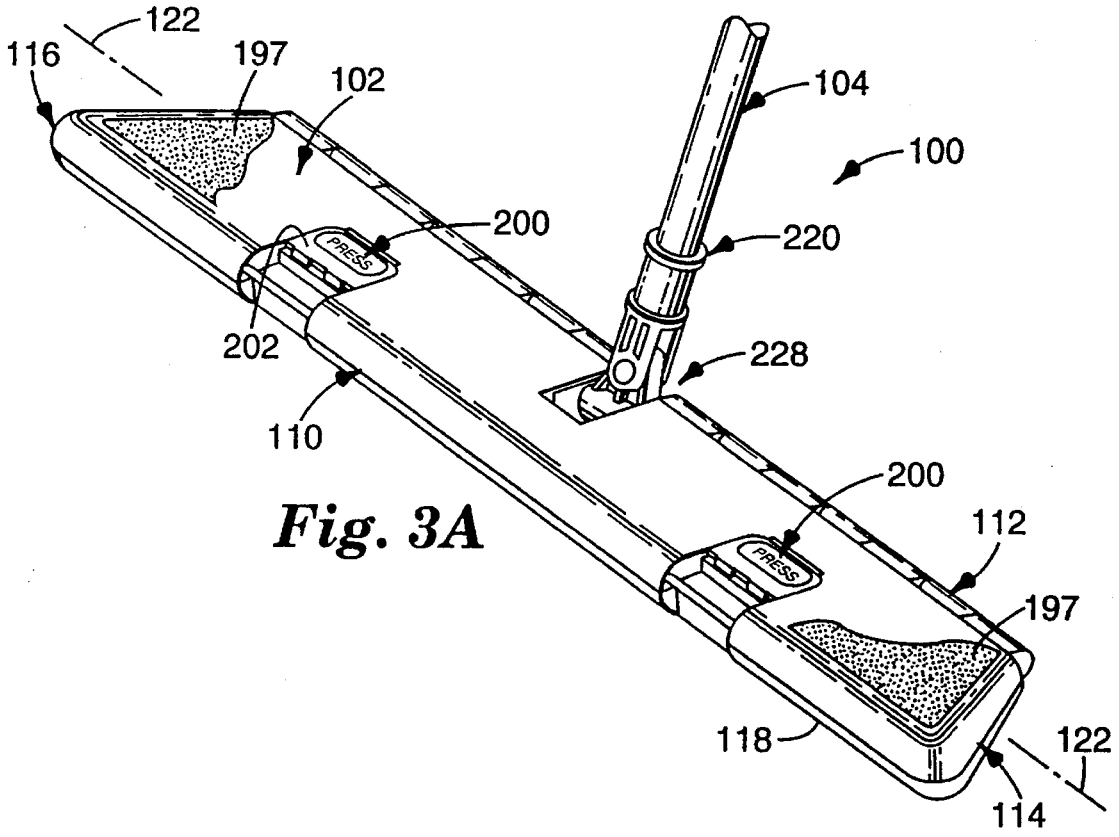
FIG. 3A is a perspective view of another embodiment of the form of the present invention including a roughened surface on the cleaning support surfaces.

The first and second cleaning support surfaces 118 and 120 may be modified, if desired. For instance, in one embodiment of the invention, a layer of a resilient material (as shown at 195A, 195B in FIG. 4E, including, but not limited to, a foamed layer polyurethane, styrene butadiene polymer, neoprene, or acrylonitrile polymer, may be applied to the first and second cleaning support surfaces 118,120 to resiliently support the cleaning sheet 140 while applied to a floor. This arrangement is particularly advantageous when a floor having an uneven surface, such a ceramic tile floor, is desired to be cleaned. Alternatively, the first and second cleaning support surfaces 118,120 may be adapted to frictionally grip the cleaning sheet. This may be accomplished by roughening the support surfaces (such as shown at 197 in FIG. 3A) such as with a knurled surface, or by the application of Safety-walk™ brand tape, or such roughened surfaces may be integrally molded or embossed into the first and second cleaning support surfaces, or applied by a "flocking" process, as is known in the art.

It is another feature of the present invention that the proportion of the cleaning sheet that is actually applied to a floor for cleaning is maximized, and that the cleaning sheet is quickly and efficiently inverted to present the opposite cleaning surface of the cleaning sheet without requiring contact with the cleaning sheet by the user. Finally, the mop head may be opened and the used cleaning sheet removed from the mop head with minimal, or preferably no, contact by the user. A fresh cleaning sheet may be inserted and secured to the mop head as previously described. Further, the floor mop described herein may be utilized as part of a floor cleaning system in combination with an extended length of the cleaning sheet material. Preferably, the extended length of the cleaning sheet material is provided in roll form. A suitable segment of the cleaning sheet material may be separated from the roll for use with the mop head.

The following describes a test of the cleaning capacity of an exemplar floor mop constructed according to the present invention:

FLOOR MOP EFFICIENCY TEST PROCEDURE

Test Floor Selection

An area 2 foot by 13 foot (61 cm×396 cm) was delineated on the vinyl tile floor of a normally maintained commercial office building.

Floor Cleaning Protocol

The area was cleaned prior to testing by vacuuming followed by wet mopping with water. The test area was allowed to air dry.

Test Soil Composition

A test soil composition was prepared by dry blending 24% by weight walnut sawdust (obtainable from Agrashell Company, Bath, Pa.); 11.5% pumice (Harcross Chemicals, Kansas City, Kans.); 6% aluminum oxide, 60–80 mesh; 6% aluminum oxide, 100–150 mesh; 22.5% silica, 180–200 mesh (obtained from Ottawa Silica Company, Ottawa, Ill.); 23% Fuller's earth (obtained from Absorbent Clay Products, Monds, Ill.); and 7% yellow pigment (C.I. Yellow 42, obtained from Columbian Chemicals Company, Atlanta, Ga.).

Test Soil Deposition

One gram of test soil was shaken reasonably uniformly along the center line down the length of the test area.

Floor Mop Assemblies

The test floor mop constructed according to FIGS. 3–11B herein, utilizing a cleaning sheet measuring 28 inches by 4.5 inches (71 cm×11 cm) resulting in a surface area approximately 26 inches by 4 inches (66 cm×10 cm) contacting the floor. The control dust mop, a Doodleduster™ brand dust mop available from the Minnesota Mining and Manufacturing Company ("3M") of St. Paul, Minn., with a dusting cloth measuring 28 inches by 7.2 inches (18 cm×71 cm) resulting in opposing cleaning surfaces of approximately 25 inches by 4.5 inches (63 cm×11 cm) contacting the floor.

Cleaning Efficacy Cycle

A tared sample of dust cloth was attached to each of the floor mops as described above. Beginning at one end of the test area, the floor mops were pushed down the length of the test area in a straight line with the floor mops generally centered along the center line of the test area. Without lifting the floor mops from the floor, the assembly was turned around and pushed back to the starting point. In this manner, some portion of the test soil was captured by the dust cloth material. After having returned to the starting point, the dust cloth was removed from the floor mop. The cloth and entrapped soil were weighed. Subtracting the tare weight of the cloth from the final weight yielded the amount of soil captured by the floor mop and cloth assembly.

Test Protocol

For each floor mop tested, the cleaning cycle was repeated five times (one treatment group) and the results averaged. After each treatment group, the test area was cleaned according to the above floor cleaning protocol.

In order to determine the most effective placement on the mop head of the attachment between the mop head and the handle member, during some cleaning cycles the handle member was held about waist high, at other times about shoulder high, and at yet other times in a position intermediate between waist and shoulder. These positions corresponded approximately to a handle-to-floor angle of about 30 degrees, 50 degrees and 40 degrees respectively.

Results

Cleaning efficacy of the mop head and floor mop cleaning system is determined in part by the weight of the mop head. When tested in accord with the above test protocol, the control floor mop, which weighs 660 grams, removed approximately 58% of the test soil on the floor. A comparable floor mop of the present invention which weighs 660 grams removed approximately 55% of the test soil. Within the limits of the tests procedure, these results were deemed to be substantially equivalent. Thus, the floor mop of the present invention provided the same cleaning efficiency while reducing the amount of cleaning sheet material required.

Cleaning efficacy of the mop head and floor mop cleaning system is also determined in part by the surface texture of the cleaning support surfaces of the mop head. Thus a mop head with a relatively hard cleaning support surface and weighing 660 grams removed 48% of the test soil whereas a similar mop head having a softer polyurethane foam cleaning support surface removed 55% of the test soil. In this experiment, the control floor mop, which has a soft foam surface, removed 58% of the test soil.

It is to be understood that even though numerous characteristics and advantages of the present invention have been set forth in the foregoing description, together with details of the steps and structure of the invention, the disclosure is illustrative only, and changes may be made in detail, within the principles of the invention to the full extend indicated by the broad general meaning of the terms in which the appendant claims are expressed.

We claim:

1. A floor mop for cleaning a floor, comprising:

(a) a mop head having a longitudinal leading edge, a longitudinal trailing edge, a first end edge and an opposing second end edge, a first cleaning support surface and an opposing second cleaning support surface;

(b) a flexible cleaning sheet having a first cleaning surface and an opposing second cleaning surface and an attachment edge;

(c) securing means for releasably attaching a portion of said cleaning sheet to the mop head adjacent to and parallel to said attachment edge of said cleaning sheet, leaving a major portion of said cleaning sheet free;

(d) a handle member adapted for manual engagement; and (e) means for universally pivotally connecting said handle member to said mop head enabling said mop head to be shifted by manipulating said handle member between a first position wherein said first cleaning support surface of said mop head is presented to the floor with said cleaning sheet interposed between said first cleaning support surface and the floor and said free portion of said cleaning sheet extending from said securing means so as to present said first cleaning surface of said cleaning sheet to encounter the floor as the mop head is moved in relation thereto, a second position wherein said second cleaning support surface of said mop head is presented to the floor with said cleaning sheet interposed between said second cleaning support surface and the floor and said free portion of said cleaning sheet extending from said securing means so as to present said second cleaning surface of said cleaning sheet to encounter the floor as the mop head is moved in relation thereto.

2. The floor mop of claim 1, wherein said cleaning sheet is a non-woven fabric constructed of polymeric fibers.

3. The floor mop of claim 2, wherein said cleaning sheet is constructed of a nonwoven web having fibers constructed of a material selected from the group consisting of: polypropylene, polyethylene, and rayon.

4. The floor mop of claim 3, wherein said cleaning sheet is a blown microfiber web constructed of fibers having a 60%/40% blend by weight of polypropylene and polyester.

5. The floor mop of claim 1, wherein said mop head comprises a first head portion and a second head portion, said first head portion and said second head portion being hingedly connected together adjacent to and parallel to said trailing edge of said mop head, wherein said first head portion and said second head portion may be rotated away from each other about said hinged connection to an open position to enable said attachment edge of said cleaning sheet to be inserted between said first head portion and said second head portion, and rotated towards each other to a closed position so as to secure a cleaning sheet inserted therebetween, and further including clamp means for releasably securing said first head portion and said second head portion in said closed position to secure said cleaning sheet therebetween as said mop head is passed over the floor to clean the floor.

6. The floor mop of claim 5, wherein said clamp means includes a magnetic latch mounted on one of said first head portion and said second head portion and a cooperative aligned magnetic member mounted on the other of the first head portion and said second head portion.

7. The floor mop of claim 5, wherein said first head portion and said second head portion are each unitary polymeric molded members.

8. The floor mop of claim 1, wherein said means for pivotally connecting said handle member to said mop head connects said handle member to said mop head at a medial location between said first end and said second end and a medial location between said trailing edge and said leading edge, and a medial location between said first cleaning support surface and said second cleaning support surface.

9. The floor mop of claim 1, wherein said means for pivotally connecting said handle member to said mop head includes a positional universal joint.

10. The floor mop of claim 1, wherein said first end edge and said second end edge are each tapered inwardly from said leading edge to said trailing edge.

11. The floor mop of claim 1, wherein at least one of said first and said second cleaning support surfaces of said mop head include a resilient cushioning layer for supporting said cleaning sheet when applied to the floor.

12. The floor mop of claim 1, wherein at least one of said first and said second cleaning support surfaces of said mop head include a roughened surface to frictionally engage said cleaning sheet when applied to the floor.

13. A floor mop for use in cleaning a floor, comprising:

(a) a flexible cleaning sheet having a first cleaning surface and an opposing second cleaning surface, a longitudinal attachment edge, and a longitudinal trailing edge, said cleaning sheet including blown microfibers constructed of polymeric materials;

(b) a mop head having a first mop head portion and a second mop head portion, each of said first mop head portion and said second mop head portion having a leading edge, a trailing edge, a first end edge and an opposing second end edge, and a cleaning support surface, said first mop head portion and said second mop head portion being hingedly connected together with said trailing edges being aligned and said cleaning support surfaces oppositely disposed, wherein said first mop head portion and said second mop head portion may be rotated away from each other about said hinged connection to an open position to enable said attachment edge of said cleaning sheet to be inserted between said first mop head portion and said second mop head portion, and rotated towards each other to a closed position with said leading edges of said first mop head portion and said second mop head portion aligned, so as to secure a portion of said cleaning sheet inserted therebetween adjacent said attachment edge so as to leave a major portion of said cleaning sheet free;

(c) clamp means for releasably securing said first mop head portion and said second mop head portion in said closed position to secure said cleaning sheet therebetween as said mop head is passed over the floor to clean the floor;

(d) a handle member adapted for manual engagement for manipulating said mop head; and (e) a connection member for pivotally connecting said handle member to said mop head, said connection member having a first part mounted on one of said first mop head portion and said second mop head portion at a medial location between said leading edges and said trailing edges of said first head portion and said second head portion, and a medial location between said first ends and said second ends of said first head portion and said second head portion, and a medial location between said cleaning support surfaces of said first mop head portion and said second mop head portion, and a second part of said connection member being connected to one end of said handle member, said connection member enabling said mop head to be shifted by manipulating said handle member between a first position with said cleaning support surface of said first mop head portion presented to the floor so as to present said first cleaning surface of said free portion of said cleaning sheet to encounter the floor as the mop head is moved in relation thereto, a second position with said cleaning support surface of said second mop head portion presented to the floor so as to present said second cleaning surface of said free portion of said cleaning sheet to encounter the floor as the mop head is moved in relation thereto.

14. The floor mop of claim 13, wherein said connection member includes a first pivotal connection rotating about an axis parallel to said leading edges of said first head portion and said second head portion, and a second pivotal connection rotating about an axis perpendicular to said axis of said first pivotal connection.

15. The floor mop of claim 13, wherein said first edges and said second edges of said first head portion and said second head portion are aligned with each other when said first head portion and said second head portion are in said closed position, are each tapered inwardly from said leading edges to said trailing edges thereof.

16. The floor mop of claim 13, wherein at least one of said cleaning support surfaces of said first mop head portion and said second mop head portion include a resilient cushioning layer for supporting said cleaning sheet when applied to the floor.

17. The floor mop of claim 13, wherein at least one of said cleaning support surfaces of said first mop head portion and second mop head portion include a roughened surface to frictionally engage said cleaning sheet when applied to the floor.

18. A floor mop for use with a disposable flexible cleaning sheet having a first cleaning surface and an opposing second cleaning surface and a longitudinal attachment edge, in cleaning a floor, the floor mop comprising:

(a) a mop head having a first mop head portion and a second mop head portion, each of said first mop head portion and said second mop head portion having a leading edge, a trailing edge, a first end and an opposing second end, and a cleaning support surface, said first mop head portion and said second mop head portion being hingedly connected together with said trailing edges being aligned and said cleaning support surfaces oppositely disposed, wherein said first mop head portion and said second mop head portion may be rotated away from each other about said hinged connection to an open position adapted to receive a portion of the cleaning sheet, and rotated towards each other to a closed position with said leading edges of said first mop head portion and said second mop head portion aligned, adapted to secure the cleaning sheet when a portion of the cleaning sheet adjacent the attachment edge is inserted therebetween leaving a major portion of the cleaning sheet free;

(b) clamp means for releasably securing said first mop head portion and said second mop head portion in said closed position adapted to secure the cleaning sheet when inserted therebetween as said mop head is passed over the floor to clean the floor;

(c) a handle member adapted for manual engagement for manipulating said mop head when the cleaning sheet is secured thereto; and (d) a connection member for pivotally connecting said handle member to said mop head, said connection member having a first part mounted on one of said first head portion and said second head portion at a medial location between said leading edges and said trailing edges of said first head portion and said second head portion, and a medial location between said first ends and said second ends of said first head portion and said second head portion, and a second part connected to one end of said handle member, said connection member enabling said mop head to be shifted by manipulating said handle member between a first position with said first cleaning support surface presented to the floor, so that when the free portion of the cleaning sheet is interposed between said first cleaning support surface and the floor and said free portion of the cleaning sheet extends from said clamp means so that said first cleaning surface of said cleaning sheet encounters the floor as said mop head is moved in relation thereto, a second position with said second cleaning support surface presented to the floor when the free portion of the cleaning sheet is interposed between said second cleaning support surface and the floor and said free portion of said cleaning sheet extends from said clamp means so that said second cleaning surface of said cleaning sheet encounters the floor as the mop head is moved in relation thereto.

19. In combination, a floor cleaning system, comprising:

(a) a length of a flexible cleaning sheet material having a first cleaning surface and an opposing second cleaning surface, a longitudinal attachment edge, and an opposing longitudinal free edge, said length of said cleaning sheet material including a plurality of transverse weakened lines for manually separating a discrete segment of said cleaning sheet material;

(b) a floor mop including (i) a mop head having a longitudinal leading edge, a longitudinal trailing edge, a first end edge and an opposing second end edge, a first cleaning support surface and an opposing second cleaning support surface;

(ii) securing means for releasably attaching a detached segment of said length of cleaning sheet to said mop head adjacent to and parallel to said attachment edge of said cleaning sheet, leaving a major portion of said cleaning sheet segment free;

(iii) a handle member adapted for manual engagement; and (iv) means for universally pivotally connecting said handle member to said mop head enabling said mop head to be shifted by manipulating said handle member between a first position with said first cleaning support surface of said mop head presented to the floor with said cleaning sheet interposed between said first cleaning support surface and the floor and said free portion of said cleaning sheet extending from said securing means so as to present said first cleaning surface of said cleaning sheet to encounter the floor as the mop head is moved in relation thereto, a second position with said second cleaning support surface of said mop head presented to the floor with said cleaning sheet interposed between said second cleaning support surface and the floor and said free portion of said cleaning sheet extending from said securing means so as to present said second cleaning surface of said cleaning sheet to encounter the floor as the mop head is moved in relation thereto;

(c) wherein Sequential segments of said cleaning sheet may be detached seriatim from the length of cleaning sheet material, attached to said mop head and applied on both cleaning support surfaces to the floor and then removed from said mop head and replaced by the next cleaning sheet segment.

20. The floor cleaning system of claim 19, wherein said transverse weakened lines in said length of cleaning sheet material are perforated lines.

* * * * *

UNITED STATES PATENT AND TRADEMARK OFFICE

CERTIFICATE OF CORRECTION

PATENT NO.: 5,461,749

DATED: October 31, 1995

INVENTOR(S): Carl S. Ahlberg, James A. Wilson, and James R. Harrison

It is certified that error appears in the above-identified patent and that said Letters Patent is hereby corrected as shown below:

Col. 2, line 17, delete "0f" and insert therefor --Of--.

Col. 3, line 57, between "is" and "top view" insert therefor --a--.

Col. 7, line 7, insert --193b-- after "latch member".

Col. 7, line 9, delete "position a spring" insert therefor --position. A spring--.

Figure 4E:
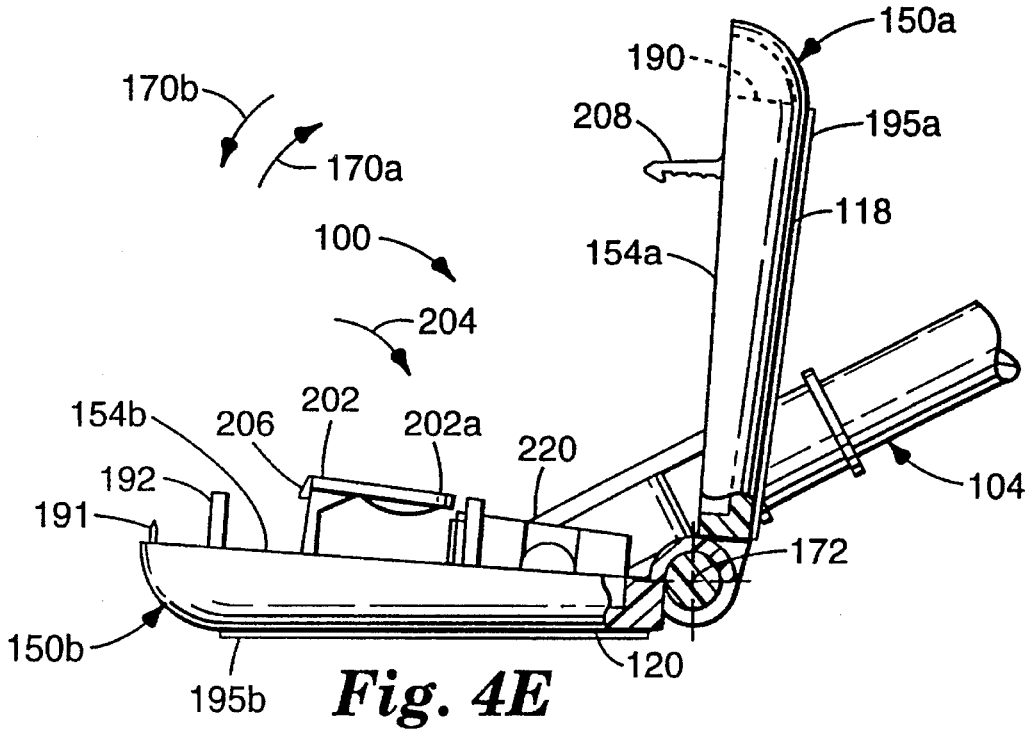
FIG. 4E is is a side view of another alternate embodiment of the present invention in an open position and including a resilient cushioning layer on each of the cleaning support surfaces.

Col. 9, line 54, after "Fig. 4E" insert therefor --)--.

Signed and Sealed this

Ninth Day of July, 1996

*Attest:*

Bruce Lehman

BRUCE LEHMAN

*Attesting Officer*

*Commissioner of Patents and Trademarks*